US008932027B2

(12) United States Patent
Wang

(10) Patent No.: US 8,932,027 B2
(45) Date of Patent: Jan. 13, 2015

(54) PORTABLE AIR PUMP WITH A PRESSURE GAUGE RECEIVABLE BY BIASING

(75) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 751 days.

(21) Appl. No.: 13/280,048

(22) Filed: Oct. 24, 2011

(65) Prior Publication Data

US 2013/0071264 A1 Mar. 21, 2013

(30) Foreign Application Priority Data

Sep. 19, 2011 (TW) ..... 100133638 A

(51) Int. Cl.
*F04B 49/00* (2006.01)
*F04B 33/00* (2006.01)

(52) U.S. Cl.
CPC ..... *F04B 33/005* (2013.01)
USPC ..... 417/63; 417/234; 417/572; 137/229; 92/58.1

(58) Field of Classification Search
CPC ..... F04B 33/00; F04B 33/05
USPC ..... 417/63, 234, 572; 403/119, 164; 137/227, 229, 228; 285/272; 92/58.1
See application file for complete search history.

(56) References Cited

U.S. PATENT DOCUMENTS

| | | | | |
|---|---|---|---|---|
| 1,880,098 | A * | 9/1932 | Mair | 285/184 |
| 5,064,226 | A * | 11/1991 | Klas | 285/184 |
| 6,558,129 | B2 * | 5/2003 | Wang | 417/63 |
| 6,736,619 | B2 * | 5/2004 | Wu | 417/572 |
| 6,805,537 | B2 * | 10/2004 | Wu | 417/63 |

* cited by examiner

*Primary Examiner* — Devon Kramer
*Assistant Examiner* — Joseph Herrmann
(74) *Attorney, Agent, or Firm* — Muncy, Geissler, Olds & Lowe, P.C.

(57) ABSTRACT

A portable air pump includes a head member located on one end of the pump body thereof and having a beveled face, a biasing member carrying a pressure gauge and having a beveled face pivotally connected to the beveled face of the head member in such a manner that the biasing member is biasable relative to the head member between a received position where the biasing member is kept in axial alignment with the portable air pump and an extended position where the pressure gauge is kept facing toward the handle of the portable air pump convenient for reading by the user and the biasing member is workable as a footplate for supporting the portable air pump on the floor for use as a floor type air pump.

6 Claims, 7 Drawing Sheets

PORTABLE AIR PUMP WITH A PRESSURE GAUGE RECEIVABLE BY BIASING

BACKGROUND OF THE INVENTION

1. Field of the Invention

The present invention relates to air pumps and more particularly, to a portable air pump equipped with a pressure gauge that is receivable by biasing.

2. Description of the Related Art

Conventional portable air pumps are commonly designed to be operated by both hands. During operation, the user shall have to hold the pump body with one hand and operate the pumping handle with the other hand. The user will get tired easily when operating a portable air pump in this manner. To overcome this problem, portable floor type air pumps are developed. When using a portable floor type air pump, the user can stop one end of the pump body against the floor and then reciprocate the pumping handle with one single hand. This operation method requires less effort. However, as the bottom surface area of this design is limited and the footplate is foldable, the structure of this design of portable air pump is unsteady and may vibration during operation, affecting operation smoothness. Further, in conventional designs, the pressure gauge is normally installed in the pump body. When the pump body is kept in vertical and stopped against the floor, the user cannot view the readings of the pressure gauge. To facilitate viewing the readings of the pressure gauge, U.S. Pat. No. 6,558,129 discloses an air pump entitled "Air pump having pressure gauge thereon", in which the pressure gauge has a face marked with indication signs in the negative form; a cover is hinged to the base of the air pump for closing the pressure gauge and has a mirror disposed at the inner side thereof and adapted to reflect the image of the reading of the indication signs of the pressure gauge. However, when the cover is opened from the pressure gauge, it is not kept perpendicular to the pump body to facilitate viewing of the reflected image of the reading of the indication signs of the pressure gauge. If the cover is kept perpendicular to the pump body when opened, the mirror cannot reflect the image of the reading of the indication signs of the pressure gauge. Thus, when the cover is opened, it is kept at a sharp angle, for example, 45-degrees angle relative to the pump body. Keeping the mirror in this angular position causes user inconvenience in reading the readings.

SUMMARY OF THE INVENTION

The present invention has been accomplished under the circumstances in view. It is the main object of the present invention to provide a portable air pump with a biasable pressure gauge, which assures operation stability and facilitates viewing of the readings of the pressure gauge during operation.

To achieve this and other objects of the present invention, a portable air pump comprises a head member located on one end of the pump body thereof and having a beveled face and a pivot shaft extending perpendicularly from the beveled face, a biasing member having a beveled face and a pivot hole located on the beveled face and coupled with the pivot shaft of the head member in such a manner that the biasing member is biasable relative to the head member between a received position where the biasing member is kept in axial alignment with the portable air pump and an extended position where the biasing member is kept in a perpendicular or quasi-perpendicular position relative to the portable air pump, and a pressure gauge installed in the biasing member.

DETAILED DESCRIPTION OF THE INVENTION

Figure 1:
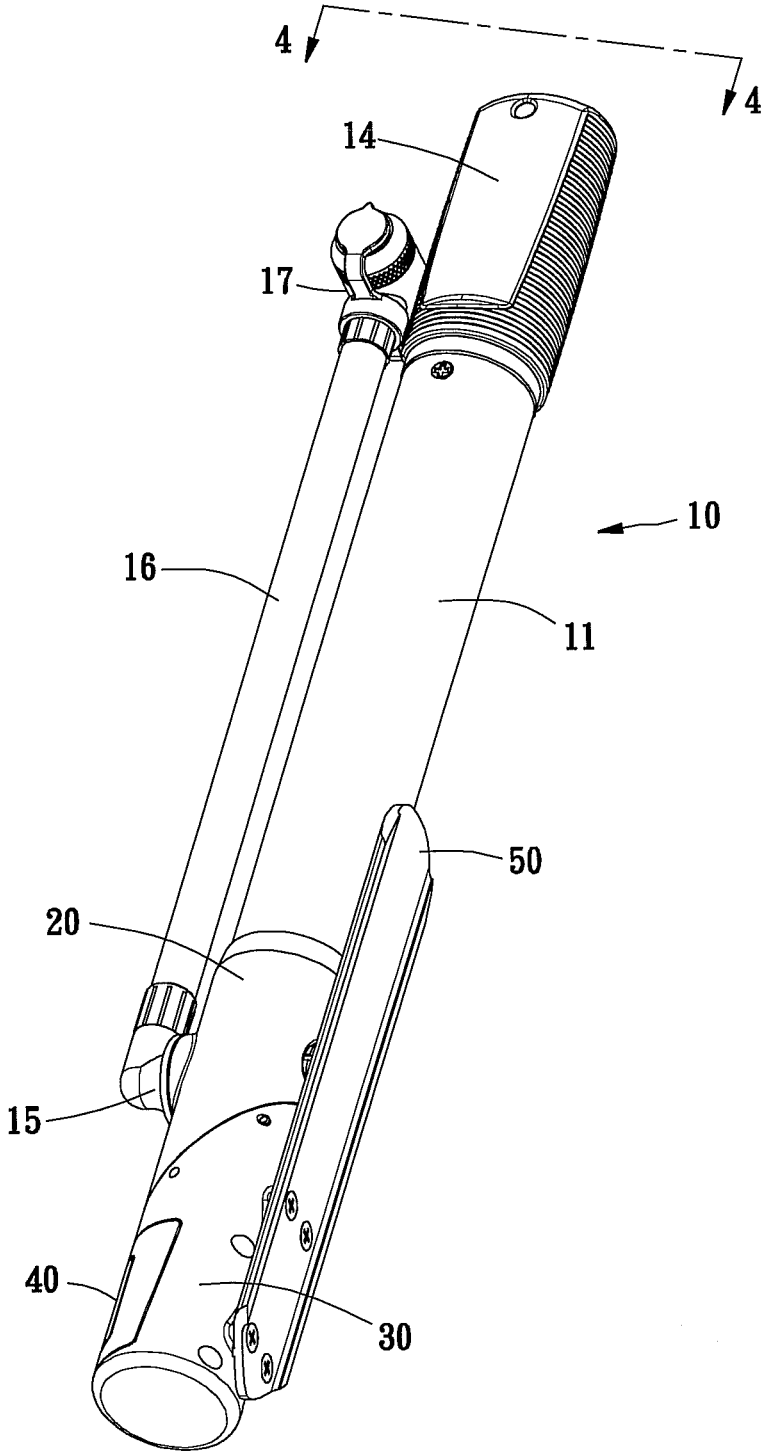
FIG. 1 is an elevational view of a portable air pump in accordance with a first embodiment of the present invention, illustrating the pressure gauge in the received position.
Figure 2:
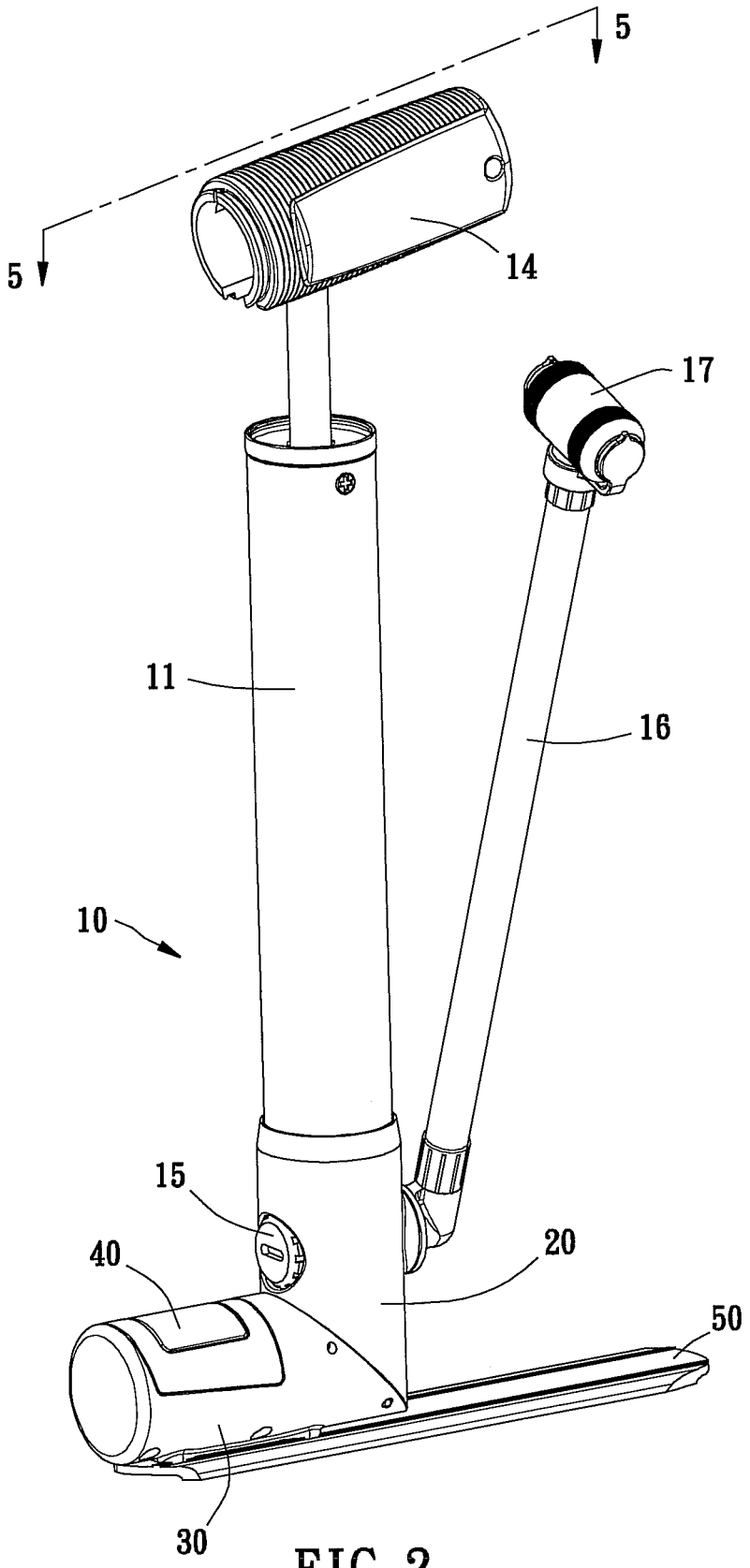
FIG. 2 corresponds to FIG. 1, illustrating the pressure gauge in the extended position.
Figure 3:
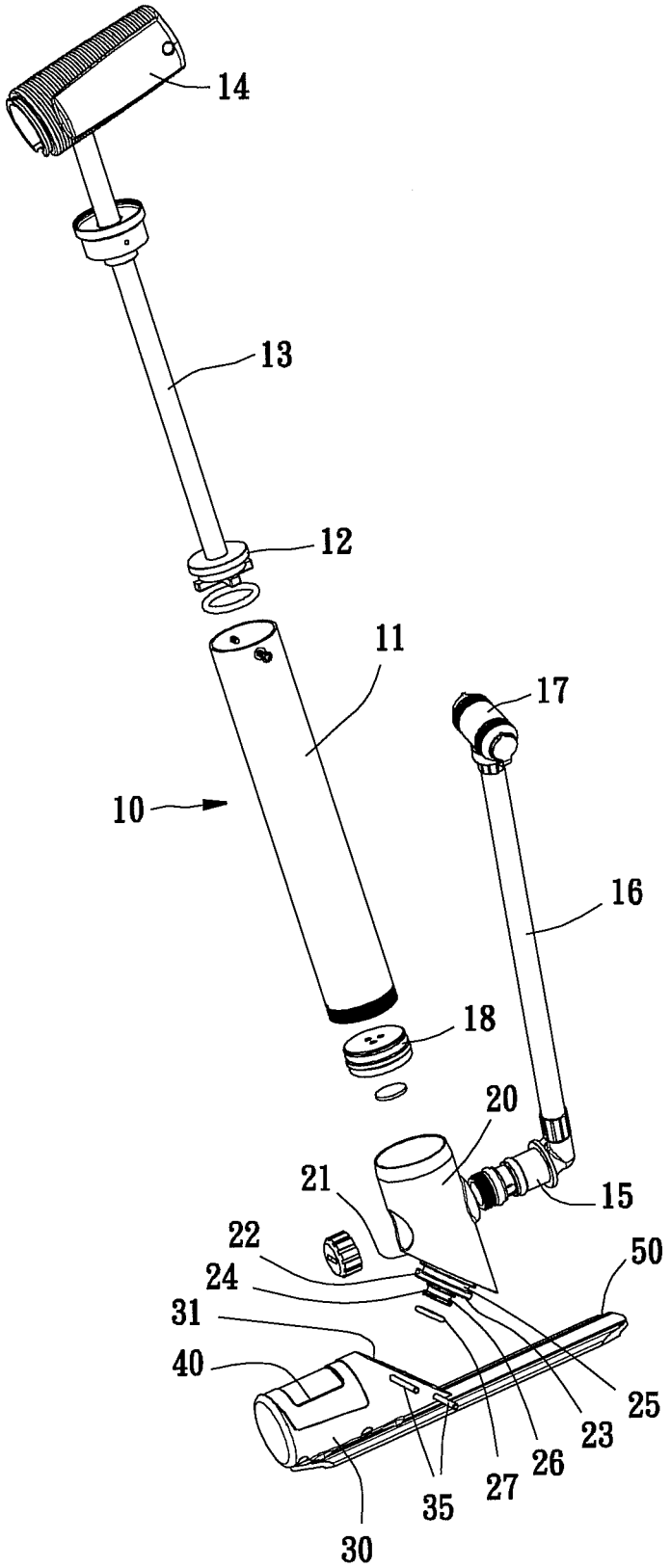
FIG. 3 is an exploded view of the portable air pump in accordance with the first embodiment of the present invention.
Figure 4:
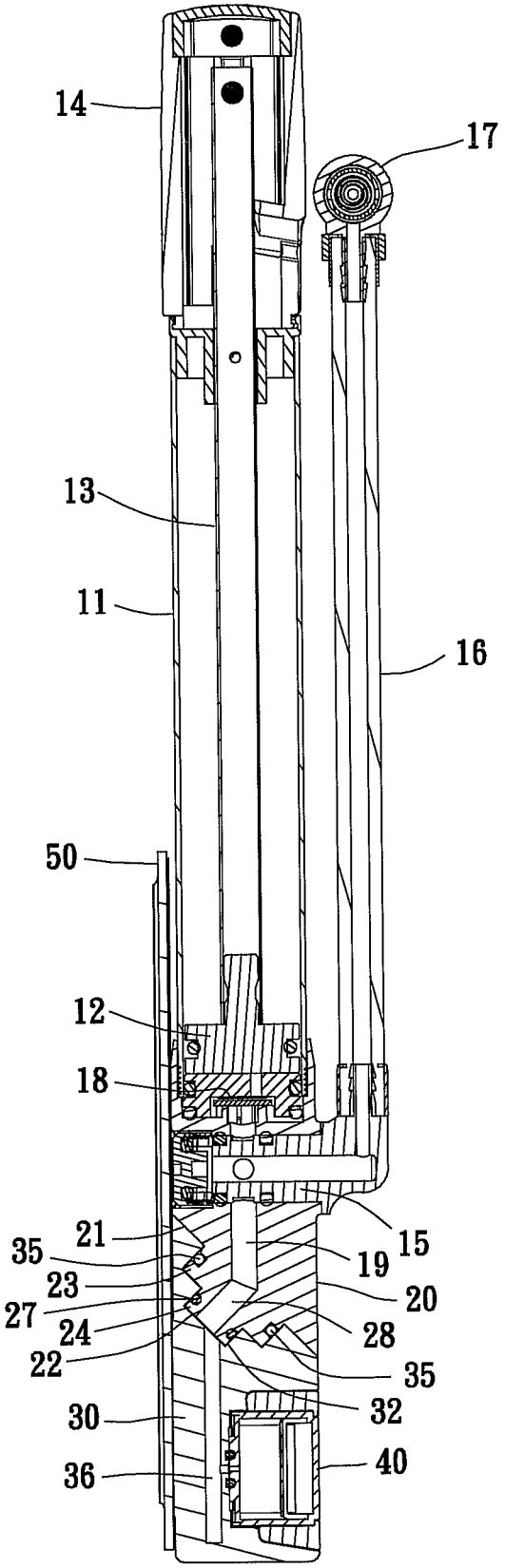
FIG. 4 is a sectional view taken along line 4-4 of FIG. 1.
Figure 5:
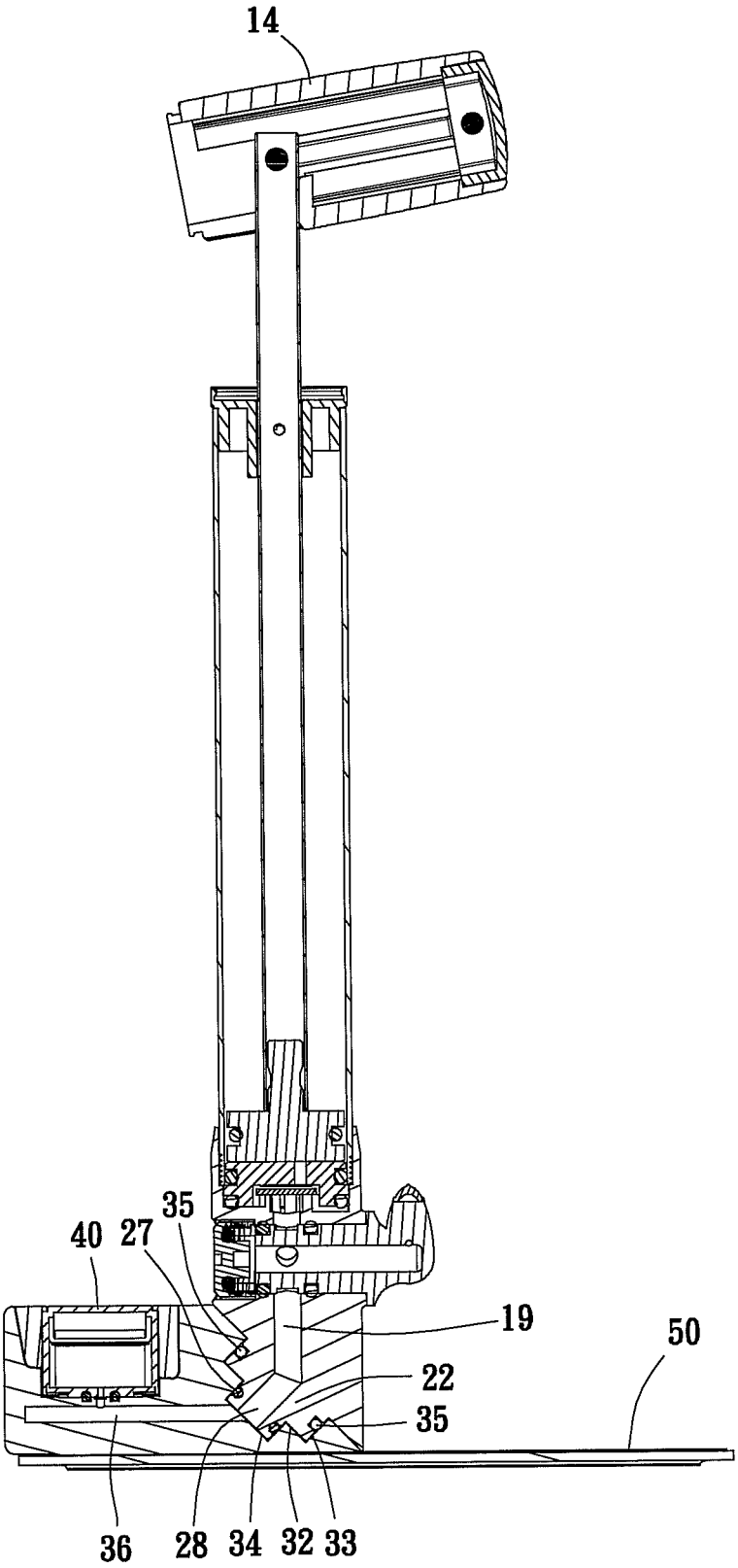
FIG. 5 is a sectional view taken along line 5-5 of FIG. 2.

Referring to FIGS. 1~5, a portable air pump 10 in accordance with a first embodiment of the present invention can be a single-cylinder single-stroke design, or multi-cylinder multi-stroke design. This embodiment adopts the simplest single-cylinder single-stroke design. As illustrated, the portable air pump 10 comprises a pump body 11 having a cylindrical shape, a piston 12 mounted in the pump body 11, a piston rod 13 having its one end fixedly connected to the piston 12 and its other end extended out of the pump body 11, a handle 14 fixedly connected to the other end of the piston rod 13 outside the pump body 11, a head member 20 fixedly located on one end of the pump body 11, an air duct 15 pivotally connected to the head member 20, a flexible tube 16 having its one end connected to the air duct 15, an air-charging connector 17 located on the other end of the flexible tube 16, a check valve 18 mounted in the head member 20, and a passage 19 defined in the head member 20 in communication with the inside space of the pump body 11, the air duct 15 and the check valve 18. The aforesaid arrangement is same as conventional air pump designs. The main features of this first embodiment are outlined hereinafter.

The head member 20 further comprises a beveled face 21 disposed at its outer end (the end opposite to the pump body 11) and sloping at 45-degrees angle, a stepped pivot shaft 22 perpendicularly extended from the beveled face 21 and defining a first endless groove 25 around the periphery of a large diameter portion 23 thereof and a second endless groove 26 around the periphery of a small diameter portion 24 thereof, a gasket ring 27 fastened to the second endless groove 26 around the periphery of the small diameter portion 24 of the stepped pivot shaft 22, and a through hole 28 axially extending through the center of the stepped pivot shaft 22 and kept in communication with the passage 19.

Referring to FIGS. 1~5 again, the portable air pump 10 further comprises a biasing member 30, a pressure gauge 40, and a supplementary member 50.

The biasing member 30 comprises a beveled face 31 disposed at one end there and sloping at 45-degrees angle, a stepped pivot hole 32 located on the beveled face 31 and extending in a perpendicular manner relative to the surface of the beveled face 31 and defining a large diameter portion 33 and a small diameter portion 34 for receiving the large diameter portion 23 and small diameter portion 24 of the stepped pivot shaft 22 respectively, two pins 35 positioned in the large diameter portion 33 of the stepped pivot hole 32 and respectively transversely suspending in the first endless groove 25 around the periphery of the large diameter portion 23 of the stepped pivot shaft 22 at two opposite sides to secure the stepped pivot shaft 22 to the stepped pivot hole 32. Thus, the biasing member 30 is pivotally connected to the head member 20 and prohibited from falling away from the head member 20 and allows for free rotation relative to the head member 20. At this time, the gasket ring 27 keeps the small diameter portion 34 of the stepped pivot hole 32 in an airtight condition. Thus, the biasing member 30 can be biased between a received position where the biasing member 30 is kept in axial alignment with the pump body 10 (see FIG. 4) and an extended position where the biasing member 30 is kept in a perpendicular or quasi-perpendicular position relative to the pump body 10 (see FIG. 5).

The pressure gauge 40 is installed in the biasing member 30 and kept in air communication with the through hole 28 of the head member 20 via a through hole 36 in the biasing member 30. When the biasing member 30 is in the extended position (see FIG. 5), the pressure gauge 40 is kept at an inner side facing toward the handle 14 of the portable air pump 10. At this time, the outer side of the biasing member 30 can be stopped against the floor, enabling the portable air pump 10 to be used as a manual floor pump. As the pressure gauge 40 is kept facing toward the handle 14, the user can read the readings of the pressure gauge 40 conveniently when operating the portable air pump 10.

The supplementary member 50 is affixed to the biasing member 30 at an opposite side relative to the pressure gauge 40. When the biasing member 30 is in the received position (see FIG. 4), the supplementary member 50 is kept close to the pump body 11. When the biasing member 30 is in the extended position (see FIG. 5), the supplementary member 50 is kept in a perpendicular position relative to the pump body 11 and partially extending out of the biasing member 30 to work as a footplate for pressing by the user's foot during pumping of the portable air pump 10.

This portable air pump 10 in accordance with the first embodiment of the present invention is a mini pump. During operation, the user can hold the pump body 11 with one hand and reciprocate the handle 14 to pump air with the other hand. At this time, the user can hold the pump body 11 in an angle convenient for viewing the readings of the pressure gauge 40. Alternatively, the user can bias the biasing member 30 through 180-degrees angle to keep the biasing member 30 and the pump body 11 in a right angle relationship, facilitating the user to view the readings of the pressure gauge 40. When the biasing member 30 is kept in perpendicular relative to the pump body 11, the portable air pump 10 can placed on the floor and kept in vertical to stop the supplementary member 50 against the floor. Thus, the portable air pump 10 can be used as a floor type air pump. At this time, the user can hold the supplementary member 50 on the floor with one leg, and then reciprocate the handle 40 with both hands to pump air efficiently with less effort. When the portable air pump 10 is not used, reverse the biasing member 30 from the extended position to the received position. Thus, the portable air pump 10 is returned to the straight form, convenient for attaching to a bicycle.

Figure 6:
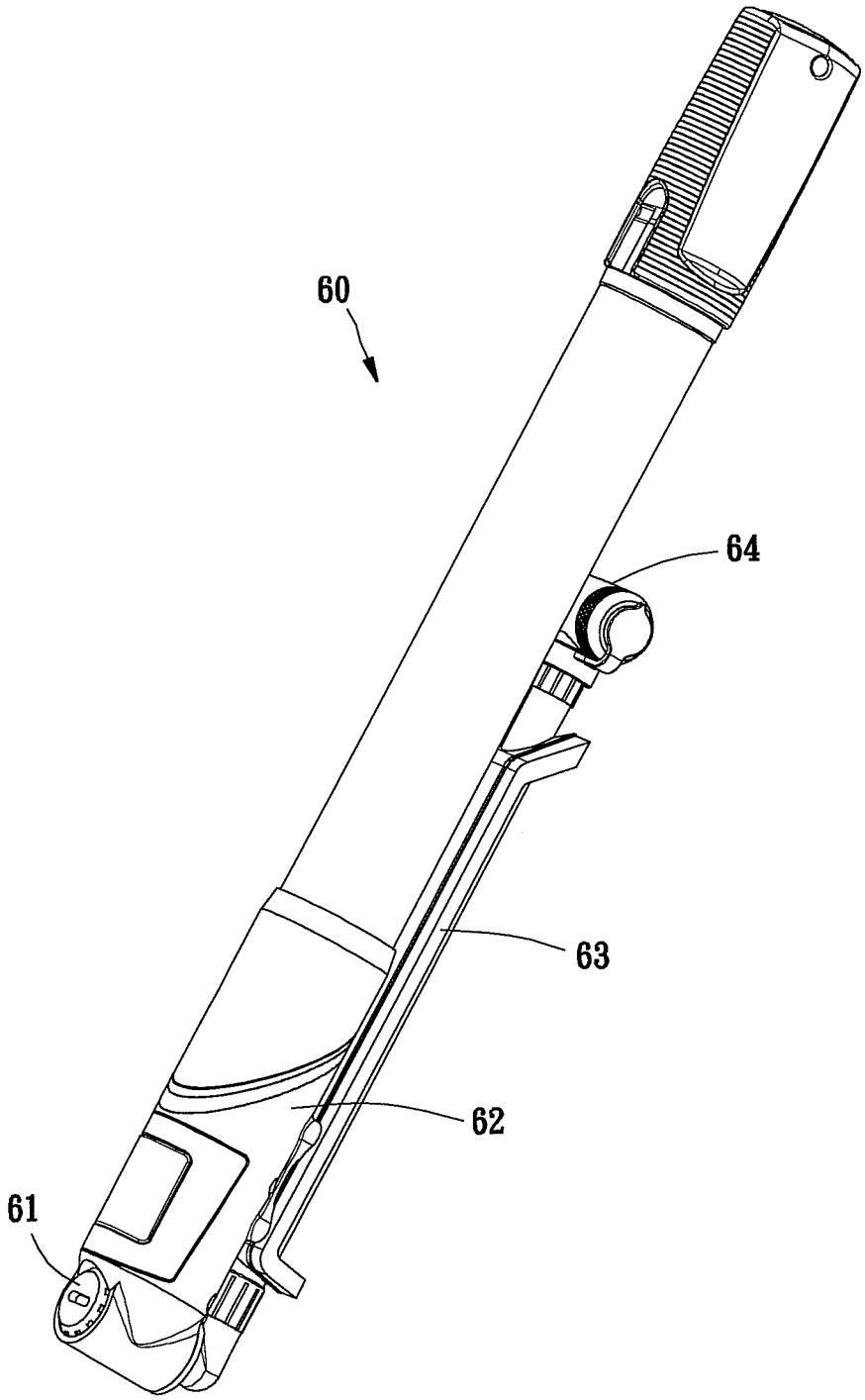
FIG. 6 is an elevational view of a portable air pump in accordance with a second embodiment of the present invention, illustrating the pressure gauge in the received position.
Figure 7:
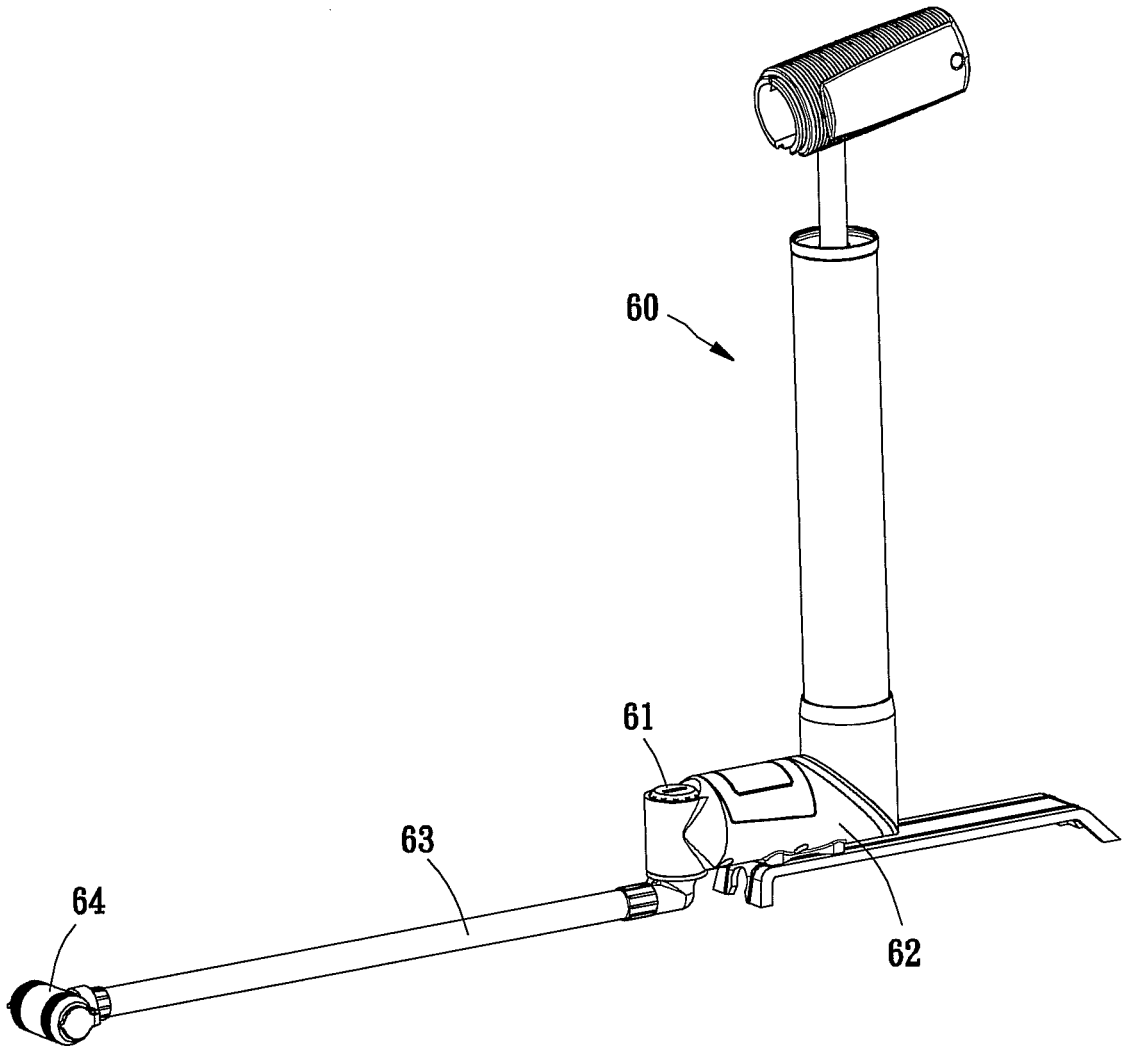
FIG. 7 corresponds to FIG. 6, illustrating the pressure gauge in the extended position.

FIGS. 6 and 7 illustrate a portable air pump 60 in accordance with a second embodiment of the present invention. This second embodiment is substantially similar to the aforesaid first embodiment with the exception that the air duct 61 of this second embodiment is located on the front end of the biasing member 62, therefore, the position of the flexible tube 63 and the position of the air-charging connector 64 are relatively changed. The operation of the portable air pump 60 in accordance with the second embodiment is same as the aforesaid first embodiment.

Further, it is to be noted that the biasing member 30 may be not kept in a perpendicular position relative to the pump body 10 when extended out. A design in which the biasing member 30 is kept close to right angles relative to the pump body 10 when extended out is also acceptable. More particularly, the configuration of added supplementary member 50 can compensate angle deficiency, keeping the pump body 11 and the floor-contact surface of the supplementary member 50 at right angles. Thus, when the portable air pump is used as a floor type air pump, the pump body can be kept perpendicular to the floor. In other words, the contained angle defined between the biasing member 30 and the head member 20 is preferably kept at 45-degrees angle, and the supplementary member 50 can compensate angle deficiency if the contained angle defined between the biasing member 30 and the head member 20 is not exactly 45-degrees angle.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A portable air pump, comprising:

a head member located on one end of the portable air pump, said head member comprising a beveled face and pivot means extending perpendicularly from the beveled face of said head member;

a biasing member, said biasing member comprising a beveled face fitting the beveled face of said head member and pivot means located on the beveled face of said biasing member and extending in a perpendicular direction relative to the beveled face of said biasing member and coupled with the pivot means of said head member in such a manner that said biasing member is biasable relative to said head member between a received position where said biasing member is kept in axial alignment with the portable air pump and an extended position where said biasing member is kept in a perpendicular or quasi-perpendicular position relative to the portable air pump; and a pressure gauge installed in said biasing member.

2. The portable air pump as claimed in claim 1, wherein the beveled face of said head member and the beveled face of said biasing member slope at 45-degrees angle.

3. The portable air pump as claimed in claim 1, further comprising a supplementary member affixed to one side of said biasing member opposite to said pressure gauge, said supplementary member being kept close to the portable air pump when said biasing member is biased to said received position, said supplementary member being kept in a perpendicular position relative to the portable air pump and partially extending out of said biasing member to work as a foot plate when said biasing member is biased to said extended position.

4. The portable air pump as claimed in claim 1, wherein the pivot means of said head member is a pivot shaft defining an axially extending through hole in communication with a passage in the portable air pump; the pivot means of said biasing member is a pivot hole coupled with the pivot shaft of the pivot means of said head member; said biasing member further comprises a through hole in communication between said pivot hole and said pressure gauge.

5. The portable air pump as claimed in claim 1, wherein the portable air pump comprises: a pump body made in a cylindrical shape and having one end thereof connected with said head member; a piston mounted in said pump body; a piston rod having one end thereof fixedly connected to said piston and an opposite end thereof extended out of said pump body; a handle fixedly connected the opposite end of said piston rod outside said pump body; an air duct pivotally connected to said head member; a flexible tube having one end thereof connected to said air duct; and an air-charging connector located on an opposite end of said flexible tube remote from said air duct.

6. The portable air pump as claimed in claim 1, wherein the portable air pump comprises: a pump body made in a cylindrical shape and having one end thereof connected with said head member; a piston mounted in said pump body; a piston rod having one end thereof fixedly connected to said piston and an opposite end thereof extended out of said pump body; a handle fixedly connected the opposite end of said piston rod outside said pump body; an air duct pivotally connected to said biasing member; a flexible tube having one end thereof connected to said air duct; and an air-charging connector located on an opposite end of said flexible tube remote from said air duct.

* * * * *